US009434535B2

(12) United States Patent
Sheppard

(10) Patent No.: US 9,434,535 B2
(45) Date of Patent: Sep. 6, 2016

(54) FUEL TANK AND METHODS OF MAKING AND USING THE SAME

(71) Applicant: Kenneth Sheppard, Vidalia, GA (US)

(72) Inventor: Kenneth Sheppard, Vidalia, GA (US)

( * ) Notice: Subject to any disclaimer, the term of this patent is extended or adjusted under 35 U.S.C. 154(b) by 115 days.

(21) Appl. No.: 14/183,863

(22) Filed: Feb. 19, 2014

(65) Prior Publication Data

US 2014/0263350 A1 Sep. 18, 2014

Related U.S. Application Data

(60) Provisional application No. 61/793,501, filed on Mar. 15, 2013.

(51) Int. Cl.

| | |
|---|---|
| ***B65D 90/02*** | (2006.01) |
| ***B65D 88/54*** | (2006.01) |
| ***B65D 90/00*** | (2006.01) |

(52) U.S. Cl.

CPC ..... *B65D 88/54* (2013.01); *B65D 90/0033* (2013.01); *B65D 90/0066* (2013.01)

(58) Field of Classification Search

CPC ..... B65D 88/54; B65D 90/0066; B65D 90/0033

See application file for complete search history.

(56) References Cited

U.S. PATENT DOCUMENTS

| | | | | |
|---|---|---|---|---|
| 2,178,564 | A * | 11/1939 | Crocker | B60K 15/077 137/263 |
| 2,539,663 | A * | 1/1951 | Hague | B60P 3/24 137/266 |
| 2,583,836 | A * | 1/1952 | Gruetjen | 138/145 |
| 2,614,708 | A * | 10/1952 | Hoffstetter | 198/532 |
| D282,921 | S | 3/1986 | Eureka et al. | |
| 4,922,999 | A * | 5/1990 | Stokes | F01P 11/02 165/101 |
| D390,182 | S | 2/1998 | Zimmerman | |
| D435,503 | S | 12/2000 | Gukeisen et al. | |
| 6,357,365 | B1 * | 3/2002 | Higgins et al. | 108/55.1 |
| D464,975 | S | 10/2002 | Lott | |
| 6,915,815 | B1 * | 7/2005 | Ness | 137/259 |
| D524,679 | S | 7/2006 | Gibbons | |
| D543,995 | S | 6/2007 | Tanaka et al. | |
| 7,484,789 | B1 | 2/2009 | Aulick | |
| D609,776 | S | 2/2010 | Nirenberg | |
| D623,720 | S | 9/2010 | Brown et al. | |
| D625,774 | S | 10/2010 | Nirenberg | |
| 8,104,501 | B1 * | 1/2012 | Ness | 137/259 |
| D661,229 | S | 6/2012 | O'Neill | |
| D696,160 | S | 12/2013 | Kittoe | |
| 8,720,970 | B1 | 5/2014 | Fletcher | |
| 2009/0277900 | A1 * | 11/2009 | Howison | B65D 90/0033 220/1.6 |
| 2009/0294486 | A1 * | 12/2009 | McKnight et al. | 222/482 |

* cited by examiner

*Primary Examiner* — Nathan J Newhouse
*Assistant Examiner* — Jennifer N Zettl
(74) *Attorney, Agent, or Firm* — Withers & Keys, LLC

(57) ABSTRACT

Fuel tanks having at least two adjacent fuel tank compartments integrally connected to one another are disclosed. Methods of making and using fuel tanks having at least two adjacent fuel tank compartments integrally connected to one another are further disclosed.

17 Claims, 8 Drawing Sheets

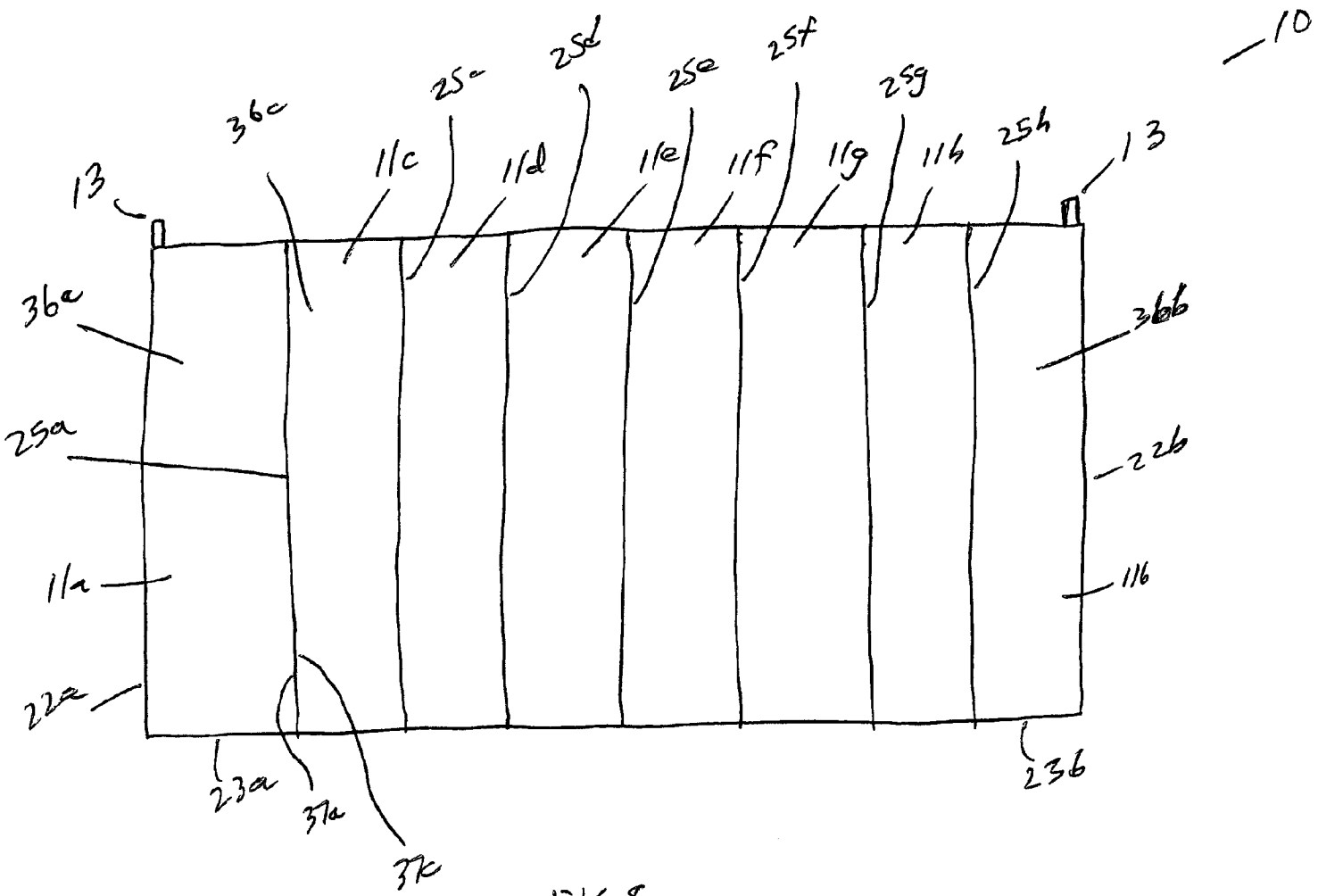
10
13
36a
25a
11a
22a
36c
36b
25b
11b
25c
11c
25d
11d
25e
11e
25f
11f
25g
11g
25h
11h
13
26a
26b
26c
26d
26e
26f
26g
26h
26i
26j
26k
26l
26m
26n
26o
26p
26q
26r
26s
26t
26u
26v
26w
26x
26y
26z
26aa
26ab
26ac
26ad
26ae
26af
26ag
26ah
26ai
26aj
26ak
26al
26am
26an
26ao
26ap
26aq
26ar
26as
26at
26au
26av
26aw
26ax
26ay
26az
26ba
26bb
26bc
26bd
26be
26bf
26bg
26bh
26bi
26bj
26bk
26bl
26bm
26bn
26bo
26bp
26bq
26br
26bs
26bt
26bu
26bv
26bw
26bx
26by
26bz
26ca
26cb
26cc
26cd
26ce
26cf
26cg
26ch
26ci
26cj
26ck
26cl
26cm
26cn
26co
26cp
26cq
26cr
26cs
26ct
26cu
26cv
26cw
26cx
26cy
26cz
26da
26db
26dc
26dd
26de
26df
26dg
26dh
26di
26dj
26dk
26dl
26dm
26dn
26do
26dp
26dq
26dr
26ds
26dt
26du
26dv
26dw
26dx
26dy
26dz
26ea
26eb
26ec
26ed
26ee
26ef
26eg
26eh
26ei
26ej
26ek
26el
26em
26en
26eo
26ep
26eq
26er
26es
26et
26eu
26ev
26ew
26ex
26ey
26ez
26fa
26fb
26fc
26fd
26fe
26ff
26fg
26fh
26fi
26fj
26fk
26fl
26fm
26fn
26fo
26fp
26fq
26fr
26fs
26ft
26fu
26fv
26fw
26fx
26fy
26fz
26ga
26gb
26gc
26gd
26ge
26gf
26gg
26gh
26gi
26gj
26gk
26gl
26gm
26gn
26go
26gp
26gq
26gr
26gs
26gt
26gu
26gv
26gw
26gx
26gy
26gz
26ha
26hb
26hc
26hd
26he
26hf
26hg
26hh
26hi
26hj
26hk
26hl
26hm
26hn
26ho
26hp
26hq
26hr
26hs
26ht
26hu
26hv
26hw
26hx
26hy
26hz
26ia
26ib
26ic
26id
26ie
26if
26ig
26ih
26ii
26ij
26ik
26il
26im
26in
26io
26ip
26iq
26ir
26is
26it
26iu
26iv
26iw
26ix
26iy
26iz
26ja
26jb
26jc
26jd
26je
26jf
26jg
26jh
26ji
26jj
26jk
26jl
26jm
26jn
26jo
26jp
26jq
26jr
26js
26jt
26ju
26jv
26jw
26jx
26jy
26jz
26ka
26kb
26kc
26kd
26ke
26kf
26kg
26kh
26ki
26kj
26kk
26kl
26km
26kn
26ko
26kp
26kq
26kr
26ks
26kt
26ku
26kv
26kw
26kx
26ky
26kz
26la
26lb
26lc
26ld
26le
26lf
26lg
26lh
26li
26lj
26lk
26ll
26lm
26ln
26lo
26lp
26lq
26lr
26ls
26lt
26lu
26lv
26lw
26lx
26ly
26lz
26ma
26mb
26mc
26md
26me
26mf
26mg
26mh
26mi
26mj
26mk
26ml
26mm
26mn
26mo
26mp
26mq
26mr
26ms
26mt
26mu
26mv
26mw
26mx
26my
26mz
26na
26nb
26nc
26nd
26ne
26nf
26ng
26nh
26ni
26nj
26nk
26nl
26nm
26nn
26no
26np
26nq
26nr
26ns
26nt
26nu
26nv
26nw
26nx
26ny
26nz
26oa
26ob
26oc
26od
26oe
26of
26og
26oh
26oi
26oj
26ok
26ol
26om
26on
26oo
26op
26oq
26or
26os
26ot
26ou
26ov
26ow
26ox
26oy
26oz
26pa
26pb
26pc
26pd
26pe
26pf
26pg
26ph
26pi
26pj
26pk
26pl
26pm
26pn
26po
26pp
26pq
26pr
26ps
26pt
26pu
26pv
26pw
26px
26py
26pz
26qa
26qb
26qc
26qd
26qe
26qf
26qg
26qh
26qi
26qj
26qk
26ql
26qm
26qn
26qo
26qp
26qq
26qr
26qs
26qt
26qu
26qv
26qw
26qx
26qy
26qz
26ra
26rb
26rc
26rd
26re
26rf
26rg
26rh
26ri
26rj
26rk
26rl
26rm
26rn
26ro
26rp
26rq
26rr
26rs
26rt
26ru
26rv
26rw
26rx
26ry
26rz
26sa
26sb
26sc
26sd
26se
26sf
26sg
26sh
26si
26sj
26sk
26sl
26sm
26sn
26so
26sp
26sq
26sr
26ss
26st
26su
26sv
26sw
26sx
26sy
26sz
26ta
26tb
26tc
26td
26te
26tf
26tg
26th
26ti
26tj
26tk
26tl
26tm
26tn
26to
26tp
26tq
26tr
26ts
26tt
26tu
26tv
26tw
26tx
26ty
26tz
26ua
26ub
26uc
26ud
26ue
26uf
26ug
26uh
26ui
26uj
26uk
26ul
26um
26un
26uo
26up
26uq
26ur
26us
26ut
26uv
26uw
26ux
26uy
26uz
26va
26vb
26vc
26vd
26ve
26vf
26vg
26vh
26vi
26vj
26vk
26vl
26vm
26vn
26vo
26vp
26vq
26vr
26vs
26vt
26vu
26vv
26vw
26vx
26vy
26vz
26wa
26wb
26wc
26wd
26we
26wf
26wg
26wh
26wi
26wj
26wk
26wl
26wm
26wn
26wo
26wp
26wq
26wr
26ws
26wt
26wu
26wv
26ww
26wx
26wy
26wz
26xa
26xb
26xc
26xd
26xe
26xf
26xg
26xh
26xi
26xj
26xk
26xl
26xm
26xn
26xo
26xp
26xq
26xr
26xs
26xt
26xu
26xv
26xw
26xx
26xy
26xz
26ya
26yb
26yc
26yd
26ye
26yf
26yg
26yh
26yi
26yj
26yk
26yl
26ym
26yn
26yo
26yp
26yq
26yr
26ys
26yt
26yu
26yv
26yw
26yx
26yy
26yz
26za
26zb
26zc
26zd
26ze
26zf
26zg
26zh
26zi
26zj
26zk
26zl
26zm
26zn
26zo
26zp
26zq
26zr
26zs
26zt
26zu
26zv
26zw
26zx
26zy
26zz
26aaa
26aab
26aac
26aad
26aae
26aaf
26aag
26aah
26aai
26aaj
26aak
26aal
26aam
26aan
26aao
26aap
26aaq
26aar
26aas
26aat
26aau
26aav
26aaw
26aax
26aay
26aaz
26aba
26abb
26abc
26abd
26abe
26abf
26abg
26abh
26abi
26abj
26abk
26abl
26abm
26abn
26abo
26abp
26abq
26abr
26abs
26abt
26abu
26abv
26abw
26abx
26aby
26abz
26aca
26acb
26acc
26acd
26ace
26acf
26acg
26ach
26aci
26acj
26ack
26acl
26acm
26acn
26aco
26acp
26acq
26acr
26acs
26act
26acu
26acv
26acw
26acx
26acy
26acz
26ada
26adb
26adc
26add
26ade
26adf
26adg
26adh
26adi
26adj
26adk
26adl
26adm
26adn
26ado
26adp
26adq
26adr
26ads
26adt
26adu
26adv
26adw
26adx
26ady
26adz
26aea
26aeb
26aec
26aed
26aee
26aef
26aeg
26aeh
26aei
26aej
26aek
26ael
26aem
26aen
26aeo
26aep
26aeq
26aer
26aes
26aet
26aeu
26aev
26aew
26aex
26aey
26aez
26afa
26afb
26afc
26afd
26afe
26aff
26afg
26afh
26afi
26afj
26afk
26afl
26afm
26afn
26afo
26afp
26afq
26afr
26afs
26aft
26afu
26afv
26afw
26afx
26afy
26afz
26aga
26agb
26agc
26agd
26age
26agf
26agg
26agh
26agi
26agj
26agk
26agl
26agm
26agn
26ago
26agp
26agq
26agr
26ags
26agt
26agu
26agv
26agw
26agx
26agy
26agz
26aha
26ahb
26ahc
26ahd
26ahe
26ahf
26ahg
26ahh
26ahi
26ahj
26ahk
26ahl
26ahm
26ahn
26aho
26ahp
26ahq
26ahr
26ahs
26aht
26ahu
26ahv
26ahw
26ahx
26ahy
26ahz
26aia
26aib
26aic
26aid
26aie
26aif
26aig
26aih
26aii
26aij
26aik
26ail
26aim
26ain
26aio
26aip
26aiq
26air
26ais
26ait
26aiu
26aiv
26aiw
26aix
26aiy
26aiz
26aja
26ajb
26ajc
26ajd
26aje
26ajf
26ajg
26ajh
26aji
26ajj
26ajk
26ajl
26ajm
26ajn
26ajo
26ajp
26ajq
26ajr
26ajs
26ajt
26aju
26ajv
26ajw
26ajx
26ajy
26ajz
26aka
26akb
26akc
26akd
26ake
26akf
26akg
26akh
26aki
26akj
26akk
26akl
26akm
26akn
26ako
26akp
26akq
26akr
26aks
26akt
26aku
26akv
26akw
26akx
26aky
26akz
26ala
26alb
26alc
26ald
26ale
26alf
26alg
26alh
26ali
26alj
26alk
26all
26alm
26aln
26alo
26alp
26alq
26alr
26als
26alt
26alu
26alv
26alw
26alx
26aly
26alz
26ama
26amb
26amc
26amd
26ame
26amf
26amg
26amh
26ami
26amj
26amk
26aml
26amm
26amn
26amo
26amp
26amq
26amr
26ams
26amt
26amu
26amv
26amw
26amx
26amy
26amz
26ana
26anb
26anc
26and
26ane
26anf
26ang
26anh
26ani
26anj
26ank
26anl
26anm
26ann
26ano
26anp
26anq
26anr
26ans
26ant
26anu
26anv
26anw
26anx
26any
26anz
26aoa
26aob
26aoc
26aod
26aoe
26aof
26aog
26aoh
26aoi
26aoj
26aok
26aol
26aom
26aon
26aoo
26aop
26aoq
26aor
26aos
26aot
26aou
26aov
26aow
26aox
26aoy
26aoz
26apa
26apb
26apc
26apd
26ape
26apf
26apg
26aph
26api
26apj
26apk
26apl
26apm
26apn
26apo
26app
26apq
26apr
26aps
26apt
26apu
26apv
26apw
26apx
26apy
26apz
26aqa
26aqb
26aqc
26aqd
26aqe
26aqf
26aqg
26aqh
26aqi
26aqj
26aqk
26aql
26aqm
26aqn
26aqo
26aqp
26aqq
26aqr
26aqs
26aqt
26aqu
26aqv
26aqw
26aqx
26aqy
26aqz
26ara
26arb
26arc
26ard
26are
26arf
26arg
26arh
26ari
26arj
26ark
26arl
26arm
26arn
26aro
26arp
26arq
26arr
26ars
26art
26aru
26arv
26arw
26arx
26ary
26arz
26asa
26asb
26asc
26asd
26ase
26asf
26asg
26ash
26asi
26asj
26ask
26asl
26asm
26asn
26aso
26asp
26asq
26asr
26ass
26ast
26asu
26asv
26asw
26asx
26asy
26asz
26ata
26atb
26atc
26atd
26ate
26atf
26atg
26ath
26ati
26atj
26atk
26atl
26atm
26atn
26ato
26atp
26atq
26atr
26ats
26att
26atu
26atv
26atw
26atx
26aty
26atz
26aua
26aub
26auc
26aud
26aue
26auf
26aug
26auh
26aui
26auj
26auk
26aul
26aum
26aun
26auo
26aup
26auq
26aur
26aus
26aut
26auu
26auv
26auw
26aux
26auy
26auz
26ava
26avb
26avc
26avd
26ave
26avf
26avg
26avh
26avi
26avj
26avk
26avl
26avm
26avn
26avo
26avp
26avq
26avr
26avs
26avt
26avu
26avv
26avw
26avx
26avy
26avz
26awa
26awb
26awc
26awd
26awe
26awf
26awg
26awh
26awi
26awj
26awk
26awl
26awm
26awn
26awo
26awp
26awq
26awr
26aws
26awt
26awu
26awv
26aww
26awx
26awy
26awz
26axa
26axb
26axc
26axd
26axe
26axf
26axg
26axh
26axi
26axj
26axk
26axl
26axm
26axn
26axo
26axp
26axq
26axr
26axs
26axt
26axu
26axv
26axw
26axx
26axy
26axz
26aya
26ayb
26ayc
26ayd
26aye
26ayf
26ayg
26ayh
26ayi
26ayj
26ayk
26ayl
26aym
26ayn
26ayo
26ayp
26ayq
26ayr
26ays
26ayt
26ayu
26ayv
26ayw
26ayx
26ayy
26ayz
26aza
26azb
26azc
26azd
26aze
26azf
26azg
26azh
26azi
26azj
26azk
26azl
26azm
26azn
26azo
26azp
26azq
26azr
26azs
26azt
26azu
26azv
26azw
26azx
26azy
26azz
26baa
26bab
26bac
26bad
26bae
26baf
26bag
26bah
26bai
26baj
26bak
26bal
26bam
26ban
26bao
26bap
26baq
26bar
26bas
26bat
26bau
26bav
26baw
26bax
26bay
26baz
26bba
26bbb
26bbc
26bbd
26bbe
26bbf
26bbg
26bbh
26bbi
26bbj
26bbk
26bbl
26bbm
26bbn
26bbo
26bbp
26bbq
26bbr
26bbs
26bbt
26bbu
26bbv
26bbw
26bbx
26bby
26bbz
26bca
26bcb
26bcc
26bcd
26bce
26bcf
26bcg
26bch
26bci
26bcj
26bck
26bcl
26bcm
26bcn
26bco
26bcp
26bcq
26bcr
26bcs
26bct
26bcu
26bcv
26bcw
26bcx
26bcy
26bcz
26bda
26bdb
26bdc
26bdd
26bde
26bdf
26bdg
26bdh
26bdi
26bdj
26bdk
26bdl
26bdm
26bdn
26bdo
26bdp
26bdq
26bdr
26bds
26bdt
26bdu
26bdv
26bdw
26bdx
26bdy
26bdz
26bea
26beb
26bec
26bed
26bee
26bef
26beg
26beh
26bei
26bej
26bek
26bel
26bem
26ben
26beo
26bep
26beq
26ber
26bes
26bet
26beu
26bev
26bew
26bex
26bey
26bez
26bfa
26bfb
26bfc
26bfd
26bfe
26bff
26bfg
26bfh
26bfi
26bfj
26bfk
26bfl
26bfm
26bfn
26bfo
26bfp
26bfq
26bfr
26bfs
26bft
26bfu
26bfv
26bfw
26bfx
26bfy
26bfz
26bga
26bgb
26bgc
26bgd
26bge
26bgf
26bgg
26bgh
26bgi
26bgj
26bgk
26bgl
26bgm
26bgn
26bgo
26bgp
26bgq
26bgr
26bgs
26bgt
26bgu
26bgv
26bgw
26bgx
26bgy
26bgz
26bha
26bhb
26bhc
26bhd
26bhe
26bhf
26bhg
26bhh
26bhi
26bhj
26bhk
26bhl
26bhm
26bhn
26bho
26bhp
26bhq
26bhr
26bhs
26bht
26bhu
26bhv
26bhw
26bhx
26bhy
26bhz
26bia
26bib
26bic
26bid
26bie
26bif
26big
26bih
26bii
26bij
26bik
26bil
26bim
26bin
26bio
26bip
26biq
26bir
26bis
26bit
26biu
26biv
26biw
26bix
26biy
26biz
26bja
26bjb
26bjc
26bjd
26bje
26bjf
26bjg
26bjh
26bji
26bjj
26bjk
26bjl
26bjm
26bjn
26bjo
26bjp
26bjq
26bjr
26bjs
26bjt
26bju
26bjv
26bjw
26bjx
26bjy
26bjz
26bka
26bkb
26bkc
26bkd
26bke
26bkf
26bkg
26bkh
26bki
26bkj
26bkk
26bkl
26bkm
26bkn
26bko
26bkp
26bkq
26bkr
26bks
26bkt
26bku
26bkv
26bkw
26bkx
26bky
26bkz
26bla
26blb
26blc
26bld
26ble
26blf
26blg
26blh
26bli
26blj
26blk
26bll
26blm
26bln
26blo
26blp
26blq
26blr
26bls
26blt
26blu
26blv
26blw
26blx
26bly
26blz
26bma
26bmb
26bmc
26bmd
26bme
26bmf
26bmg
26bmh
26bmi
26bmj
26bmk
26bml
26bmm
26bmn
26bmo
26bmp
26bmq
26bmr
26bms
26bmt
26bmu
26bmv
26bmw
26bmx
26bmy
26bmz
26bna
26bnb
26bnc
26bnd
26bne
26bnf
26bng
26bnh
26bni
26bnj
26bnk
26bnl
26bnm
26bnn
26bno
26bnp
26bnq
26bnr
26bns
26bnt
26bnu
26bnv
26bnw
26bnx
26bny
26bnz
26boa
26bob
26boc
26bod
26boe
26bof
26bog
26boh
26boi
26boj
26bok
26bol
26bom
26bon
26boo
26bop
26boq
26bor
26bos
26bot
26bou
26bov
26bow
26box
26boy
26boz
26bpa
26bpb
26bpc
26bpd
26bpe
26bpf
26bpg
26bph
26bpi
26bpj
26bpk
26bpl
26bpm
26bpn
26bpo
26bpp
26bpq
26bpr
26bps
26bpt
26bpu
26bpv
26bpw
26bpx
26bpy
26bpz
26bqa
26bqb
26bqc
26bqd
26bqe
26bqf
26bqg
26bqh
26bqi
26bqj
26bqk
26bql
26bqm
26bqn
26bqo
26bqp
26bqq
26bqr
26bqs
26bqt
26bqu
26bqv
26bqw
26bqx
26bqy
26bqz
26bra
26brb
26brc
26brd
26bre
26brf
26brg
26brh
26bri
26brj
26brk
26brl
26brm
26brn
26bro
26brp
26brq
26brr
26brs
26brt
26bru
26brv
26brw
26brx
26bry
26brz
26bsa
26bsb
26bsc
26bsd
26bse
26bsf
26bsg
26bsh
26bsi
26bsj
26bsk
26bsl
26bsm
26bsn
26bso
26bsp
26bsq
26bsr
26bss
26bst
26bsu
26bsv
26bsw
26bsx
26bsy
26bsz
26bta
26btb
26btc
26btd
26bte
26btf
26btg
26bth
26bti
26btj
26btk
26btl
26btm
26btn
26bto
26btp
26btq
26btr
26bts
26btt
26btu
26btv
26btw
26btx
26bty
26btz
26bua
26bub
26buc
26bud
26bue
26buf
26bug
26buh
26bui
26buj
26buk
26bul
26bum
26bun
26buo
26bup
26buq
26bur
26bus
26but
26buu
26buv
26buw
26bux
26buy
26buz
26bva
26bvb
26bvc
26bvd
26bve
26bvf
26bvg
26bvh
26bvi
26bvj
26bvk
26bvl
26bvm
26bvn
26bvo
26bvp
26bvq
26bvr
26bvs
26bvt
26bvu
26bvv
26bvw
26bvx
26bvy
26bvz
26bwa
26bwb
26bwc
26bwd
26bwe
26bwf
26bwg
26bwh
26bwi
26bwj
26bwk
26bwl
26bwm
26bwn
26bwo
26bwp
26bwq
26bwr
26bws
26bwt
26bwu
26bwv
26bww
26bwx
26bwy
26bwz
26bxa
26bxb
26bxc
26bxd
26bxe
26bxf
26bxg
26bxh
26bxi
26bxj
26bxk
26bxl
26bxm
26bxn
26bxo
26bxp
26bxq
26bxr
26bxs
26bxt
26bxu
26bxv
26bxw
26bxx
26bxy
26bxz
26bya
26byb
26byc
26byd
26bye
26byf
26byg
26byh
26byi
26byj
26byk
26byl
26bym
26byn
26byo
26byp
26byq
26byr
26bys
26byt
26byu
26byv
26byw
26byx
26byy
26byz
26bza
26bzb
26bzc
26bzd
26bze
26bzf
26bzg
26bzh
26bzi
26bzj
26bzk
26bzl
26bzm
26bzn
26bzo
26bzp
26bzq
26bzr
26bzs
26bzt
26bzu
26bzv
26bzw
26bzx
26bzy
26bzz
26caa
26cab
26cac
26cad
26cae
26caf
26cag
26cah
26cai
26caj
26cak
26cal
26cam
26can
26cao
26cap
26caq
26car
26cas
26cat
26cau
26cav
26caw
26cax
26cay
26caz
26cba
26cbb
26cbc
26cbd
26cbe
26cbf
26cbg
26cbh
26cbi
26cbj
26cbk
26cbl
26cbm
26cbn
26cbo
26cbp
26cbq
26cbr
26cbs
26cbt
26cbu
26cbv
26cbw
26cbx
26cby
26cbz
26cca
26ccb
26ccc
26ccd
26cce
26ccf
26ccg
26cch
26cci
26ccj
26cck
26ccl
26ccm
26ccn
26cco
26ccp
26ccq
26ccr
26ccs
26cct
26ccu
26ccv
26ccw
26ccx
26ccy
26ccz
26cda
26cdb
26cdc
26cdd
26cde
26cdf
26cdg
26cdh
26cdi
26cdj
26cdk
26cdl
26cdm
26cdn
26cdo
26cdp
26cdq
26cdr
26cds
26cdt
26cdu
26cdv
26cdw
26cdx
26cdy
26cdz
26cea
26ceb
26cec
26ced
26cee
26cef
26ceg
26ceh
26cei
26cej
26cek
26cel
26cem
26cen
26ceo
26cep
26ceq
26cer
26ces
26cet
26ceu
26cev
26cew
26cex
26cey
26cez
26cfa
26cfb
26cfc
26cfd
26cfe
26cff
26cfg
26cfh
26cfi
26cfj
26cfk
26cfl
26cfm
26cfn
26cfo
26cfp
26cfq
26cfr
26cfs
26cft
26cfu
26cfv
26cfw
26cfx
26cfy
26cfz
26cga
26cgb
26cgc
26cgd
26cge
26cgf
26cgg
26cgh
26cgi
26cgj
26cgk
26cgl
26cgm
26cgn
26cgo
26cgp
26cgq
26cgr
26cgs
26cgt
26cgu
26cgv
26cgw
26cgx
26cgy
26cgz
26cha
26chb
26chc
26chd
26che
26chf
26chg
26chh
26chi
26chj
26chk
26chl
26chm
26chn
26cho
26chp
26chq
26chr
26chs
26cht
26chu
26chv
26chw
26chx
26chy
26chz
26cia
26cib
26cic
26cid
26cie
26cif
26cig
26cih
26cii
26cij
26cik
26cil
26cim
26cin
26cio
26cip
26ciq
26cir
26cis
26cit
26ciu
26civ
26ciw
26cix
26ciy
26ciz
26cja
26cjb
26cjc
26cjd
26cje
26cjf
26cjg
26cjh
26cji
26cjj
26cjk
26cjl
26cjm
26cjn
26cjo
26cjp
26cjq
26cjr
26cjs
26cjt
26cju
26cjv
26cjw
26cjx
26cjy
26cjz
26cka
26ckb
26ckc
26ckd
26cke
26ckf
26ckg
26ckh
26cki
26ckj
26ckk
26ckl
26ckm
26ckn
26cko
26ckp
26ckq
26ckr
26cks
26ckt
26cku
26ckv
26ckw
26ckx
26cky
26ckz
26cla
26clb
26clc
26cld
26cle
26clf
26clg
26clh
26cli
26clj
26clk
26cll
26clm
26cln
26clo
26clp
26clq
26clr
26cls
26clt
26clu
26clv
26clw
26clx
26cly
26clz
26cma
26cmb
26cmc
26cmd
26cme
26cmf
26cmg
26cmh
26cmi
26cmj
26cmk
26cml
26cmm
26cmn
26cmo
26cmp
26cmq
26cmr
26cms
26cmt
26cmu
26cmv
26cmw
26cmx
26cmy
26cmz
26cna
26cnb
26cnc
26cnd
26cne
26cnf
26cng
26cnh
26cni
26cnj
26cnk
26cnl
26cnm
26cnn
26cno
26cnp
26cnq
26cnr
26cns
26cnt
26cnu
26cnv
26cnw
26cnx
26cny
26cnz
26coa
26cob
26coc
26cod
26coe
26cof
26cog
26coh
26coi
26coj
26cok
26col
26com
26con
26coo
26cop
26coq
26cor
26cos
26cot
26cou
26cov
26cow
26cox
26coy
26coz
26cpa
26cpb
26cpc
26cpd
26cpe
26cpf
26cpg
26cph
26cpi
26cpj
26cpk
26cpl
26cpm
26cpn
26cpo
26cpp
26cpq
26cpr
26cps
26cpt
26cpu
26cpv
26cpw
26cpx
26cpy
26cpz
26cqa
26cqb
26cqc
26cqd
26cqe
26cqf
26cqg
26cqh
26cqi
26cqj
26cqk
26cql
26cqm
26cqn
26cqo
26cqp
26cqq
26cqr
26cqs
26cqt
26cqu
26cqv
26cqw
26cqx
26cqy
26cqz
26cra
26crb
26crc
26crd
26cre
26crf
26crg
26crh
26cri
26crj
26crk
26crl
26crm
26crn
26cro
26crp
26crq
26crr
26crs
26crt
26cru
26crv
26crw
26crx
26cry
26crz
26csa
26csb
26csc
26csd
26cse
26csf
26csg
26csh
26csi
26csj
26csk
26csl
26csm
26csn
26cso
26csp
26csq
26csr
26css
26cst
26csu
26csv
26csw
26csx
26csy
26csz
26cta
26ctb
26ctc
26ctd
26cte
26ctf
26ctg
26cth
26cti
26ctj
26ctk
26ctl
26ctm
26ctn
26cto
26ctp
26ctq
26ctr
26cts
26ctt
26ctu
26ctv
26ctw
26ctx
26cty
26ctz
26cua
26cub
26cuc
26cud
26cue
26cuf
26cug
26cuh
26cui
26cuj
26cuk
26cul
26cum
26cun
26cuo
26cup
26cuq
26cur
26cus
26cut
26cuu
26cuv
26cuw
26cux
26cuy
26cuz
26cva
26cvb
26cvc
26cvd
26cve
26cvf
26cvg
26cvh
26cvi
26cvj
26cvk
26cvl
26cvm
26cvn
26cvo
26cvp
26cvq
26cvr
26cvs
26cvt
26cvu
26cvv
26cvw
26cvx
26cvy
26cvz
26cwa
26cwb
26cwc
26cwd
26cwe
26cwf
26cwg
26cwh
26cwi
26cwj
26cwk
26cwl
26cwm
26cwn
26cwo
26cwp
26cwq
26cwr
26cws
26cwt
26cwu
26cwv
26cww
26cwx
26cwy
26cwz
26cxa
26cxb
26cxc
26cxd
26cxe
26cxf
26cxg
26cxh
26cxi
26cxj
26cxk
26cxl
26cxm
26cxn
26cxo
26cxp
26cxq
26cxr
26cxs
26cxt
26cxu
26cxv
26cxw
26cxx
26cxy
26cxz
26cya
26cyb
26cyc
26cyd
26cye
26cyf
26cyg
26cyh
26cyi
26cyj
26cyk
26cyl
26cym
26cyn
26cyo
26cyp
26cyq
26cyr
26cys
26cyt
26cyu
26cyv
26cyw
26cyx
26cyy
26cyz
26cza
26czb
26czc
26czd
26cze
26czf
26czg
26czh
26czi
26czj
26czk
26czl
26czm
26czn
26czo
26czp
26czq
26czr
26czs
26czt
26czu
26czv
26czw
26czx
26czy
26czz
26daa
26dab
26dac
26dad
26dae
26daf
26dag
26dah
26dai
26daj
26dak
26dal
26dam
26dan
26dao
26dap
26daq
26dar
26das
26dat
26dau
26dav
26daw
26dax
26day
26daz
26dba
26dbb
26dbc
26dbd
26dbe
26dbf
26dbg
26dbh
26dbi
26dbj
26dbk
26dbl
26dbm
26dbn
26dbo
26dbp
26dbq
26dbr
26dbs
26dbt
26dbu
26dbv
26dbw
26dbx
26dby
26dbz
26dca
26dcb
26dcc
26dcd
26dce
26dcf
26dcg
26dch
26dci
26dcj
26dck
26dcl
26dcm
26dcn
26dco
26dcp
26dcq
26dcr
26dcs
26dct
26dcu
26dcv
26dcw
26dcx
26dcy
26dcz
26dda
26ddb
26ddc
26ddd
26dde
26ddf
26ddg
26ddh
26ddi
26ddj
26ddk
26ddl
26ddm
26ddn
26ddo
26ddp
26ddq
26ddr
26dds
26ddt
26ddu
26ddv
26ddw
26ddx
26ddy
26ddz
26dea
26deb
26dec
26ded
26dee
26def
26deg
26deh
26dei
26dej
26dek
26del
26dem
26den
26deo
26dep
26deq
26der
26des
26det
26deu
26dev
26dew
26dex
26dey
26dez
26dfa
26dfb
26dfc
26dfd
26dfe
26dff
26dfg
26dfh
26dfi
26dfj
26dfk
26dfl
26dfm
26dfn
26dfo
26dfp
26dfq
26dfr
26dfs
26dft
26dfu
26dfv
26dfw
26dfx
26dfy
26dfz
26dga
26dgb
26dgc
26dgd
26dge
26dgf
26dgg
26dgh
26dgi
26dgj
26dgk
26dgl
26dgm
26dgn
26dgo
26dgp
26dgq
26dgr
26dgs
26dgt
26dgu
26dgv
26dgw
26dgx
26dgy
26dgz
26dha
26dhb
26dhc
26dhd
26dhe
26dhf
26dhg
26dhh
26dhi
26dhj
26dhk
26dhl
26dhm
26dhn
26dho
26dhp
26dhq
26dhr
26dhs
26dht
26dhu
26dhv
26dhw
26dhx
26dhy
26dhz
26dia
26dib
26dic
26did
26die
26dif
26dig
26dih
26dii
26dij
26dik
26dil
26dim
26din
26dio
26dip
26diq
26dir
26dis
26dit
26diu
26div
26diw
26dix
26diy
26diz
26dja
26djb
26djc
26djd
26dje
26djf
26djg
26djh
26dji
26djj
26djk
26djl
26djm
26djn
26djo
26djp
26djq
26djr
26djs
26djt
26dju
26djv
26djw
26djx
26djy
26djz
26dka
26dkb
26dkc
26dkd
26dke
26dkf
26dkg
26dkh
26dki
26dkj
26dkk
26dkl
26dkm
26dkn
26dko
26dkp
26dkq
26dkr
26dks
26dkt
26dku
26dkv
26dkw
26dkx
26dky
26dkz
26dla
26dlb
26dlc
26dld
26dle
26dlf
26dlg
26dlh
26dli
26dlj
26dlk
26dll
26dlm
26dln
26dlo
26dlp
26dlq
26dlr
26dls
26dlt
26dlu
26dlv
26dlw
26dlx
26dly
26dlz
26dma
26dmb
26dmc
26dmd
26dme
26dmf
26dmg
26dmh
26dmi
26dmj
26dmk
26dml
26dmm
26dmn
26dmo
26dmp
26dmq
26dmr
26dms
26dmt
26dmu
26dmv
26dmw
26dmx
26dmy
26dmz
26dna
26dnb
26dnc
26dnd
26dne
26dnf
26dng
26dnh
26dni
26dnj
26dnk
26dnl
26dnm
26dnn
26dno
26dnp
26dnq
26dnr
26dns
26dnt
26dnu
26dnv
26dnw
26dnx
26dny
26dnz
26doa
26dob
26doc
26dod
26doe
26dof
26dog
26doh
26doi
26doj
26dok
26dol
26dom
26don
26doo
26dop
26doq
26dor
26dos
26dot
26dou
26dov
26dow
26dox
26doy
26doz
26dpa
26dpb
26dpc
26dpd
26dpe
26dpf
26dpg
26dph
26dpi
26dpj
26dpk
26dpl
26dpm
26dpn
26dpo
26dpp
26dpq
26dpr
26dps
26dpt
26dpu
26dpv
26dpw
26dpx
26dpy
26dpz
26dqa
26dqb
26dqc
26dqd
26dqe
26dqf
26dqg
26dqh
26dqi
26dqj
26dqk
26dql
26dqm
26dqn
26dqo
26dqp
26dqq
26dqr
26dqs
26dqt
26dqu
26dqv
26dqw
26dqx
26dqy
26dqz
26dra
26drb
26drc
26drd
26dre
26drf
26drg
26drh
26dri
26drj
26drk
26drl
26drm
26drn
26dro
26drp
26drq
26drr
26drs
26drt
26dru
26drv
26drw
26drx
26dry
26drz
26dsa
26dsb
26dsc
26dsd
26dse
26dsf
26dsg
26dsh
26dsi
26dsj
26dsk
26dsl
26dsm
26dsn
26dso
26dsp
26dsq
26dsr
26dss
26dst
26dsu
26dsv
26dsw
26dsx
26dsy
26dsz
26dta
26dtb
26dtc
26dtd
26dte
26dtf
26dtg
26dth
26dti
26dtj
26dtk
26dtl
26dtm
26dtn
26dto
26dtp
26dtq
26dtr
26dts
26dtt
26dtu
26dtv
26dtw
26dtx
26dty
26dtz
26dua
26dub
26duc
26dud
26due
26duf
26dug
26duh
26dui
26duj
26duk
26dul
26dum
26dun
26duo
26dup
26duq
26dur
26dus
26dut
26duu
26duv
26duw
26dux
26duy
26duz
26dva
26dvb
26dvc
26dvd
26dve
26dvf
26dvg
26dvh
26dvi
26dvj
26dvk
26dvl
26dvm
26dvn
26dvo
26dvp
26dvq
26dvr
26dvs
26dvt
26dvu
26dvv
26dvw
26dvx
26dvy
26dvz
26dwa
26dwb
26dwc
26dwd
26dwe
26dwf
26dwg
26dwh
26dwi
26dwj
26dwk
26dwl
26dwm
26dwn
26dwo
26dwp
26dwq
26dwr
26dws
26dwt
26dwu
26dwv
26dww
26dwx
26dwy
26dwz
26dxa
26dxb
26dxc
26dxd
26dxe
26dxf
26dxg
26dxh
26dxi
26dxj
26dxk
26dxl
26dxm
26dxn
26dxo
26dxp
26dxq
26dxr
26dxs
26dxt
26dxu
26dxv
26dxw
26dxx
26dxy
26dxz
26dya
26dyb
26dyc
26dyd
26dye
26dyf
26dyg
26dyh
26dyi
26dyj
26dyk
26dyl
26dym
26dyn
26dyo
26dyp
26dyq
26dyr
26dys
26dyt
26dyu
26dyv
26dyw
26dyx
26dyy
26dyz
26dza
26dzb
26dzc
26dzd
26dze
26dzf
26dzg
26dzh
26dzi
26dzj
26dzk
26dzl
26dzm
26dzn
26dzo
26dzp
26dzq
26dzr
26dzs
26dzt
26dzu
26dzv
26dzw
26dzx
26dzy
26dzz
26eaa
26eab
26eac
26ead
26eae
26eaf
26eag
26eah
26eai
26eaj
26eak
26eal
26eam
26ean
26eao
26eap
26eaq
26ear
26eas
26eat
26eau
26eav
26eaw
26eax
26eay
26eaz
26eba
26ebb
26ebc
26ebd
26ebe
26ebf
26ebg
26ebh
26ebi
26ebj
26ebk
26ebl
26ebm
26ebn
26ebo
26ebp
26ebq
26ebr
26ebs
26ebt
26ebu
26ebv
26ebw
26ebx
26eby
26ebz
26eca
26ecb
26ecc
26ecd
26ece
26ecf
26ecg
26ech
26eci
26ecj
26eck
26ecl
26ecm
26ecn
26eco
26ecp
26ecq
26ecr
26ecs
26ect
26ecu
26ecv
26ecw
26ecx
26ecy
26ecz
26eda
26edb
26edc
26edd
26ede
26edf
26edg
26edh
26edi
26edj
26edk
26edl
26edm
26edn
26edo
26edp
26edq
26edr
26eds
26edt
26edu
26edv
26edw
26edx
26edy
26edz
26eea
26eeb
26eec
26eed
26eee
26eef
26eeg
26eeh
26eei
26eej
26eek
26eel
26eem
26een
26eeo
26eep
26eeq
26eer
26ees
26eet
26eeu
26eev
26eew
26eex
26eey
26eez
26efa
26efb
26efc
26efd
26efe
26eff
26efg
26efh
26efi
26efj
26efk
26efl
26efm
26efn
26efo
26efp
26efq
26efr
26efs
26eft
26efu
26efv
26efw
26efx
26efy
26efz
26ega
26egb
26egc
26egd
26ege
26egf
26egg
26egh
26egi
26egj
26egk
26egl
26egm
26egn
26ego
26egp
26egq
26egr
26egs
26egt
26egu
26egv
26egw
26egx
26egy
26egz
26eha
26ehb
26ehc
26ehd
26ehe
26ehf
26ehg
26ehh
26ehi
26ehj
26ehk
26ehl
26ehm
26ehn
26eho
26ehp
26ehq
26ehr
26ehs
26eht
26ehu
26ehv
26ehw
26ehx
26ehy
26ehz
26eia
26eib
26eic
26eid
26eie
26eif
26eig
26eih
26eii
26eij
26eik
26eil
26eim
26ein
26eio
26eip
26eiq
26eir
26eis
26eit
26eiu
26eiv

FUEL TANK AND METHODS OF MAKING AND USING THE SAME

CROSS-REFERENCE TO RELATED APPLICATIONS

This patent application claims the benefit of priority to U.S. provisional patent application Ser. No. 61/793,501 entitled "FUEL TANK AND METHODS OF MAKING AND USING THE SAME" filed on Mar. 15, 2013, the subject matter of which is incorporated herein in its entirety.

FIELD OF THE INVENTION

This invention generally relates to fuel tanks. This invention also relates to methods of making fuel tanks, as well as methods of using fuel tanks.

BACKGROUND

Efforts continue to further develop fuel tanks so as to enhance efficiency while meeting all state and federal guidelines for fuel tanks.

SUMMARY OF THE INVENTION

The present invention is directed to fuel tanks. In one exemplary embodiment, the fuel tank comprises at least two adjacent fuel tank compartments integrally connected to one another, with each fuel tank compartment comprising a fuel tank compartment inlet opening along an upper surface of said fuel tank compartment, a fuel tank compartment outlet opening along a lower front surface of said fuel tank compartment, and a fuel tank compartment outlet member extending outward from said fuel tank compartment outlet opening and upward along said lower front surface.

The present invention is further directed to fuel tanks in combination with one or more of the following: a hose, one or more lifting members, one or more outlet members, one or more inlet members, etc.

The present invention is also directed to methods of making fuel tanks. In one exemplary embodiment, the method of making a fuel tank of the present invention comprises combining one or more sheets of material to form the fuel tank. In some embodiments, the combining step may comprise cutting one or more sheets of material to form individual wall portions of the fuel tank, and welding two or more individual wall portions to one another to form the fuel tank.

The present invention is even further directed to methods of using fuel tanks. In one exemplary embodiment, the method of using a fuel tank comprises one or more of the following steps: loading the fuel tank onto a bed of a vehicle; unloading the fuel tank off of a bed of a vehicle (e.g., a truck); filling one or more of the fuel tank compartments; and pumping fuel from one or more of the fuel tank compartments.

These and other features and advantages of the present invention will become apparent after a review of the following detailed description of the disclosed embodiments and the appended claims.

BRIEF DESCRIPTION OF DRAWINGS

The invention may be more completely understood and appreciated in consideration of the following detailed description of various embodiments of the invention in connection with the accompanying drawings, in which:

FIG. 8 is a cross-sectional view of the exemplary fuel tank shown in FIG. 1 as viewed along line 8-8 shown in FIGS. 1 and 4-5.

In the specification, a same reference numeral used in multiple figures refers to the same or similar elements having the same or similar properties and functionalities.

DETAILED DESCRIPTION

The present invention is directed to fuel tanks such as exemplary fuel tank 10 shown in FIGS. 1-8. The present invention is further directed to methods of making and using fuel tanks such as exemplary fuel tank 10 shown in FIGS. 1-8.

Figure 1:
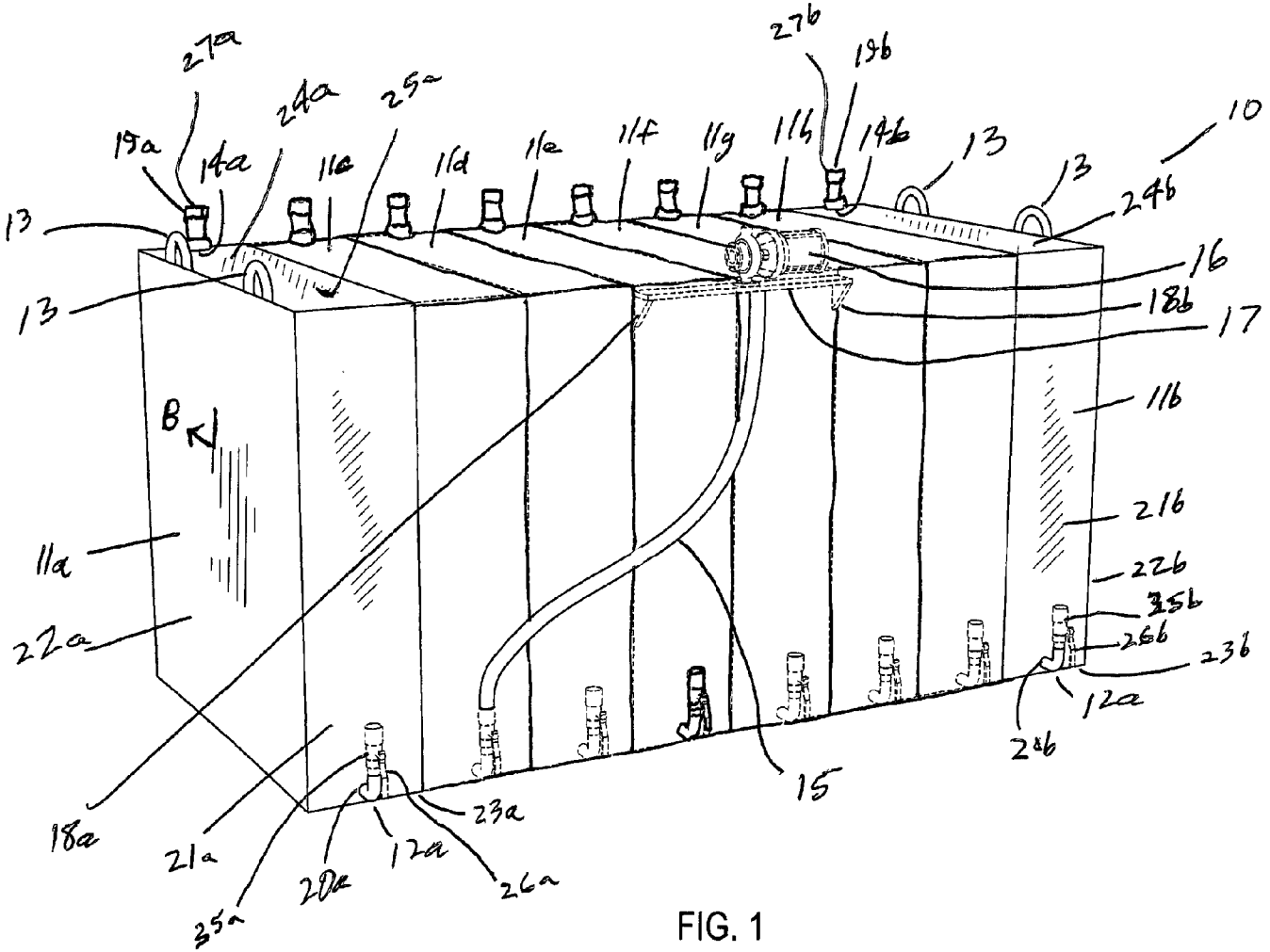
FIG. 1 is a perspective view of an exemplary fuel tank of the present invention.
Figure 2:
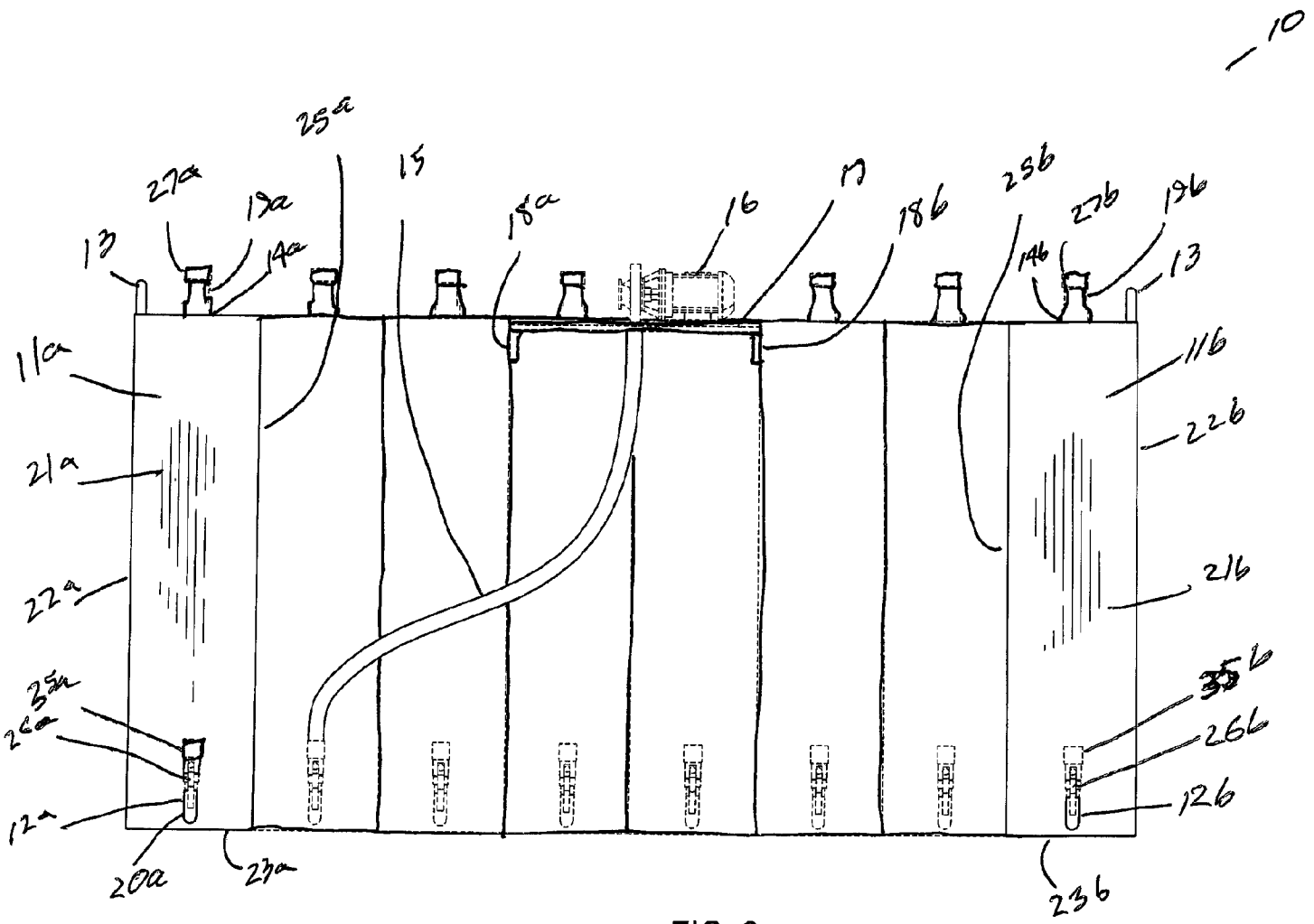
FIG. 2 is a front view of the exemplary fuel tank shown in FIG. 1.
Figure 3:
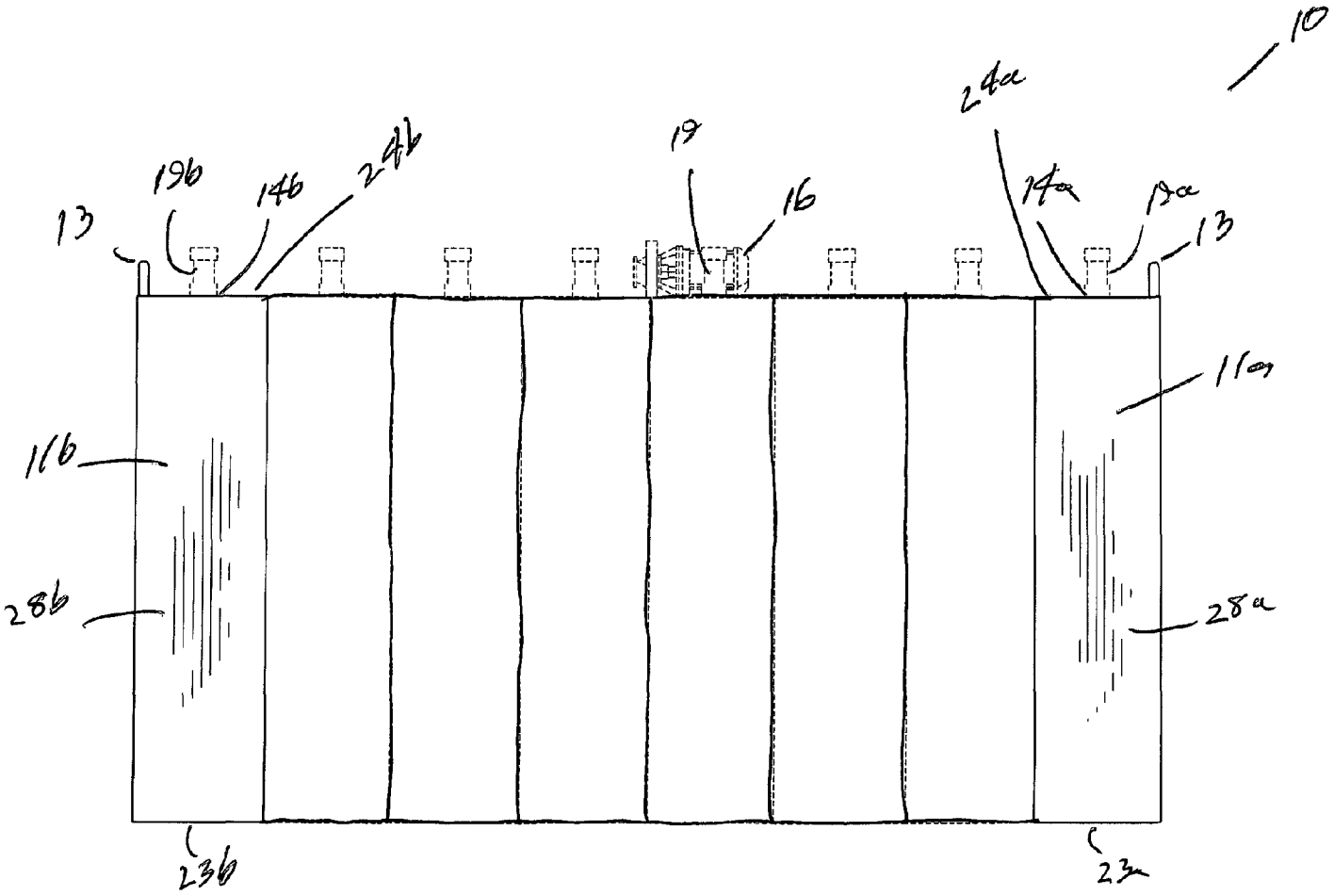
FIG. 3 is a rear view of the exemplary fuel tank shown in FIG. 1.
Figure 4:
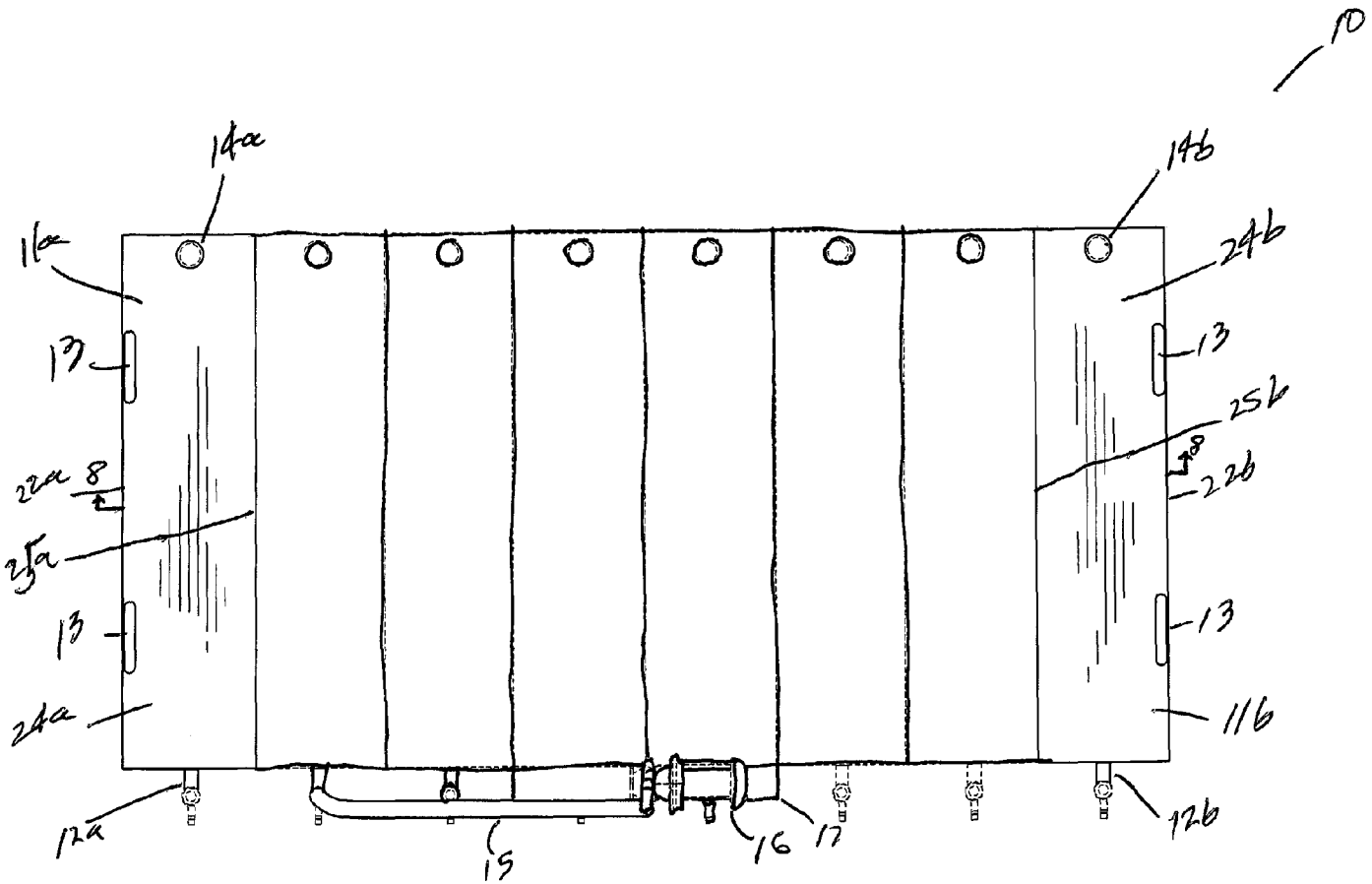
FIG. 4 is a top view of the exemplary fuel tank shown in FIG. 1.
Figure 5:
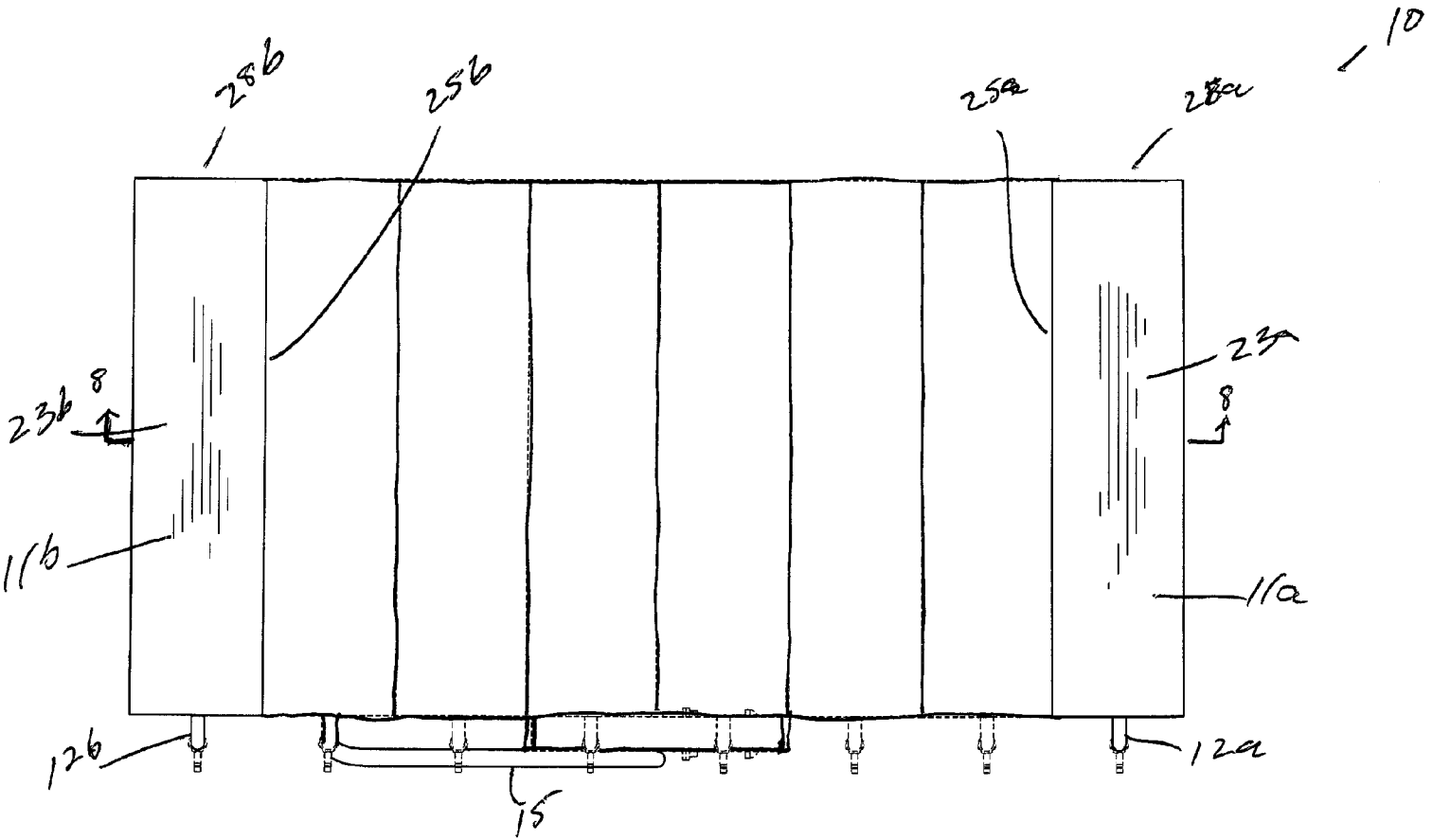
FIG. 5 is a bottom view of the exemplary fuel tank shown in FIG. 1.
Figure 6:
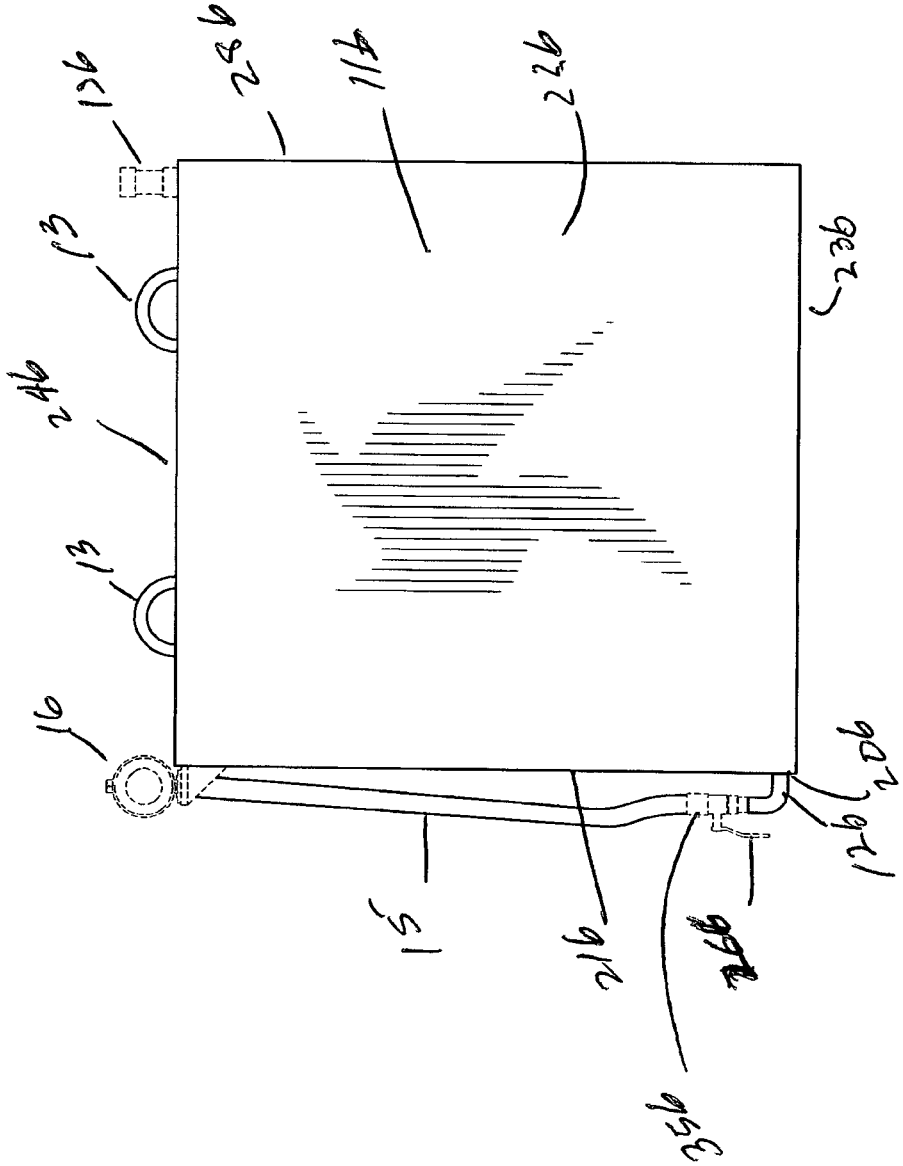
FIG. 6 is a right view of the exemplary fuel tank shown in FIG. 1.
Figure 7:
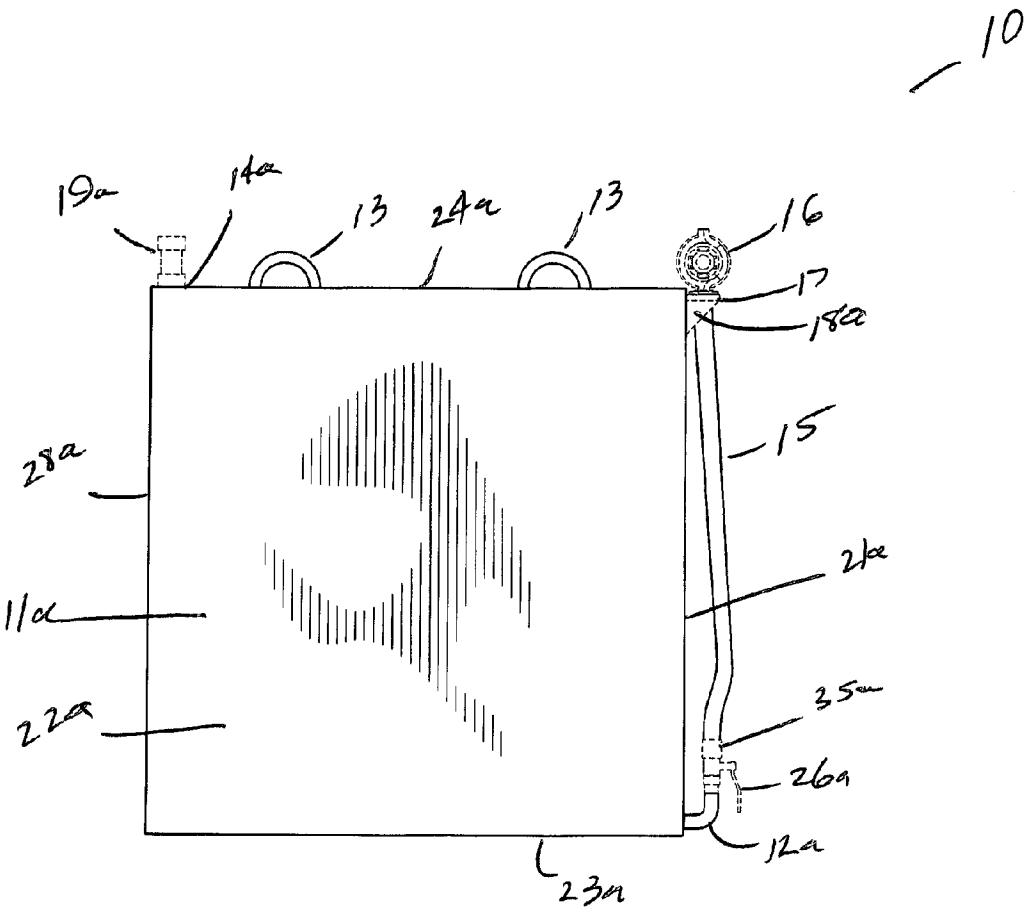
FIG. 7 is a left view of the exemplary fuel tank shown in FIG. 1.

As shown in FIG. 1, exemplary fuel tank 10 comprises at least two adjacent fuel tank compartments 11 integrally connected to one another, with each fuel tank compartment 11 comprising a fuel tank compartment inlet opening 14 along an upper surface 24 of said fuel tank compartment 11, a fuel tank compartment outlet opening 20 along a lower front surface 21 of said fuel tank compartment 11, and a fuel tank compartment outlet member 12 extending outward from said fuel tank compartment outlet opening 11 and upward along said lower front surface 21.

As shown in FIG. 1, exemplary fuel tank 10 comprises eight adjacent fuel tank compartments 11*a* to 11*h* integrally connected to one another. As further discussed below, exemplary fuel tank 10 may also comprise lifting members 13, hose 15, pump 16 and bracket 17.

The present invention is further directed to methods of making fuel tanks such as exemplary fuel tank 10. As discussed above, in one exemplary embodiment, the method of making a fuel tank 10 of the present invention comprises combining one or more sheets of material (i.e., a sheet to form outer side surface 22*a*, a sheet to form inner side surface 25*a*, a sheet to form front surface 21*a*, a sheet to form rear surface 28*a*, a sheet to form upper surface 24*a*, and a sheet to form lower surface 23*a* of fuel tank compartments 11*a*) to form the fuel tank 10. In some embodiments, the combining step may comprise cutting one or more sheets of material to form individual wall portions of the fuel tank 10, and welding two or more individual wall portions to one another to form the fuel tank 10 (i.e., welding the sheet forming outer side surface 22*a* to the sheet to forming front surface 21*a*, a sheet to form rear surface 28*a*, the sheet forming upper surface 24*a*, and the sheet forming lower surface 23*a* of fuel tank compartments 11*a*). Methods of making fuel tanks 10 of the present invention may further comprise one or more additional steps including, but not limited to, attaching a fuel tank compartment outlet member 12 to a given fuel tank compartment outlet opening 11;

attaching a fuel tank compartment inlet member 19 to a given fuel tank compartment inlet opening 14; attaching one or more lifting members to opposite sides/upper surface portions of the two outmost fuel tank compartments (i.e., fuel tank compartments 11*a* and 11*b* as shown in FIG. 1); attaching a hose connector 35 to fuel tank compartment outlet member 12; attaching a shut-off valve 26 to fuel tank compartment outlet member 19 or to a hose connector 35; attaching a hose 15 to fuel tank compartment outlet member 12 or to a hose connector 35 or to a shut-off valve 26 or to a pump 16; or any combination thereof.

The present invention is even further directed to methods of using fuel tanks such as exemplary fuel tank 10. As discussed above, in one exemplary embodiment, the method of using a fuel tank 10 comprises one or more of the following steps: loading the fuel tank 10 onto a bed of a vehicle (not shown); unloading the fuel tank 10 off of a bed of a vehicle (e.g., a truck); filling one or more of the fuel tank compartments 11 with fuel (not shown); and pumping fuel from one or more of the fuel tank compartments 11.

Additional Embodiments

Fuel Tanks

1. A fuel tank 10 comprising: at least two adjacent fuel tank compartments 11 (i.e., fuel tank compartments 11*a* to 11*h*) integrally connected to one another, with each fuel tank compartment 11 comprising: a fuel tank compartment inlet opening 14 along an upper surface 24 of said fuel tank compartment 11, a fuel tank compartment outlet opening 20 along a lower front surface 21 of said fuel tank compartment 11, and a fuel tank compartment outlet member 12 extending outward from said fuel tank compartment outlet opening 20 and upward along said lower front surface 21.
2. The fuel tank 10 of embodiment 1, wherein said fuel tank compartment outlet member 12 has a first end 121*a* connectable to said fuel tank compartment outlet opening 20 and a second end 122*a* opposite said first end 121*a*, said second end 122*a* having a fuel tank compartment outlet member opening 123*a* that is substantially parallel to said upper surface 24.
3. The fuel tank 10 of embodiment 1 or 2, wherein said fuel tank compartment outlet member 12 extends outward from said lower front surface 21*a* distance $d_1$ with $d_1$ being less than about 6.0 inches (or $d_1$ can be any distance between about 0.1 inch and about 6.0 inches, or any range therebetween, e.g., from about 1.5 inches to about 3.5 inches).
4. The fuel tank 10 of any one of embodiments 1 to 3, wherein said fuel tank compartment outlet member 12 extends upward along said lower front surface 21 a distance $d_2$ with $d_2$ being less than about 6.0 inches (or $d_2$ can be any distance between about 0.1 inch and about 6.0 inches, or any range therebetween, e.g., from about 1.5 inches to about 3.5 inches).
5. The fuel tank 10 of any one of embodiments 1 to 4, wherein said fuel tank compartment outlet member 12 extends outward from said lower front surface 21 and upward at a 90 angle to an outlet direction of said fuel tank compartment outlet opening
6. The fuel tank 10 of any one of embodiments 1 to 5, further comprising one or more lifting members 13 positioned proximate each of opposite upper surface portions 24*a* and 24*b* of said fuel tank 10. See, for example, in FIG. 1, where lifting members 13 are positioned on opposite sides of exemplary fuel tank 10 along outside edges of the outmost fuel tank compartments 11*a* and 11*b*. Lifting members 13 may have any configuration that enables fuel tank 10 to be lifted (e.g., via a forklift) onto the bed of a truck, for example. Lifting members 13 may, for example, be welded onto opposite upper surface portions 24*a* and 24*b* or opposite outer surface portions 22*a* and 22*b*.
7. The fuel tank 10 of any one of embodiments 1 to 6, further comprising two lifting members 13 positioned proximate each of opposite upper surface portions 24*a* and 24*b* of said fuel tank.
8. The fuel tank 10 of any one of embodiments 1 to 7, further comprising two lifting members 13 positioned along and welded to opposite upper surface portions 24*a* and 24*b* or opposite side surface portions 22*a* and 22*b* of said fuel tank 10.
9. The fuel tank 10 of any one of embodiments 1 to 8, further comprising two lifting members 13 positioned along and welded to opposite upper surface portions 24*a* and 24*b* of said fuel tank 10.
10. The fuel tank 10 of any one of embodiments 6 to 9, wherein each of said one or more lifting members 13 comprises a semi-circular shaped member having a first shaped member end 131 and a second shaped member end 132 opposite said first shaped member end 131.
11. The fuel tank 10 of embodiment 10, wherein each of said first shaped member end 131 and said second shaped member end 132 are attached to said fuel tank 10 proximate opposite upper surface portions 24*a* and 24*b* or opposite side surface portions 22*a* and 22*b* of said fuel tank 10.
12. The fuel tank 10 of any one of embodiments 1 to 11, further comprising a single shared wall between any two adjacent fuel tank compartments 11.
13. The fuel tank 10 of any one of embodiments 1 to 12, wherein said fuel tank 10 comprises n adjacent fuel tank compartments 11 integrally connected to one another, and (n+1) total vertically-extending side walls 25 within said fuel tank 10. See, for example, FIG. 8.
14. The fuel tank 10 of embodiment 13, wherein n ranges from 2 to 16.
15. The fuel tank 10 of embodiment 13 or 14, wherein n ranges from 3 to 8.
16. The fuel tank 10 of any one of embodiments 13 to 15, wherein n is 8.
17. The fuel tank 10 of any one of embodiments 1 to 16, wherein all adjacent fuel tank compartments 11 share a bottom wall 23 of said fuel tank 10.
18. The fuel tank 10 of any one of embodiments 1 to 17, wherein a bottom wall 23 of said fuel tank 10 does not have any openings therein.
19. The fuel tank 10 of any one of embodiments 1 to 18, wherein all adjacent fuel tank compartments 11 share a front wall 21 of said fuel tank 10.
20. The fuel tank 10 of any one of embodiments 1 to 19, wherein all adjacent fuel tank compartments 11 share a rear wall 28 of said fuel tank 10.
21. The fuel tank 10 of any one of embodiments 1 to 20, wherein all adjacent fuel tank compartments 11 share a top wall 24 of said fuel tank 10.
22. The fuel tank 10 of any one of embodiments 1 to 21, further comprising a hose 15 having a hose length that enables said hose 15 to extend from (i) any fuel tank compartment outlet opening 20 to (ii) a central location along an upper portion of said front surface 21 proximate said upper surface 24.
23. The fuel tank 10 of any one of embodiments 1 to 22, further comprising a hose 15 having a first hose end 151 connected to any fuel tank compartment outlet opening 20 and a second hose end 152 opposite said first hose end 151.

24. The fuel tank 10 of any one of embodiments 1 to 23, further comprising (I) a hose 15 having a hose length that enables said hose 15 to extend from (i) any fuel tank compartment outlet opening 20 to (ii) a central location along an upper portion of said front surface 21 proximate said upper surface 24, and (II) a pump 16 connectable to said hose 15.
25. The fuel tank 10 of embodiment 24, wherein said second hose end 152 is connectable to said pump 16 (either directly or indirectly via a coupling/connector).
26. The fuel tank 10 of any one of embodiments 1 to 25, further comprising a hose connector 35 for each fuel tank compartment 11, wherein each hose connector 35 is size so as to connect to (i) said fuel tank compartment outlet member 12 (directly or indirectly), and (ii) a hose 15 or said hose 15 of any one of embodiments 22 to 25.
27. The fuel tank 10 of any one of embodiments 1 to 26, further comprising a shut-off valve 26 for each fuel tank compartment 11, wherein each shut-off valve 26 is size so as to connect to (i) said fuel tank compartment outlet opening 20 or (ii) said fuel tank compartment outlet member 12 (directly or indirectly) so as to be positioned between said fuel tank compartment 11 and a hose 15 or said hose 15 of any one of embodiments 22 to 26.
28. The fuel tank 10 of any one of embodiments 1 to 27, further comprising a shelf 17 extending along an upper portion of said front surface 21, said shelf 17 being sized so as to support a pump 16 positioned thereon.
29. The fuel tank 10 of any one of embodiments 1 to 28, further comprising (I) a shelf 17 extending along an upper portion of said front surface 21, said shelf 17 being sized so as to support a pump 16 positioned thereon, and (II) one or more brackets 18 (e.g., brackets 18*a* and 18*b*) supporting said shelf 17 along said upper portion of said front surface 21.
30. The fuel tank 10 of any one of embodiments 1 to 29, wherein each fuel tank compartment 11 comprises a fuel tank compartment inlet member 19 extending upward from said upper surface 21.
31. The fuel tank 10 of embodiment 30, wherein each fuel tank compartment inlet member 19 is positioned within an outer periphery of said fuel tank 10 (i.e., no portion of any fuel tank compartment inlet member 19 extends beyond an outer periphery of said fuel tank 10).
32. The fuel tank 10 of any one of embodiments 1 to 31, wherein said fuel tank 10 has an overall width of about 8 ft, an overall height of about 4 ft, and an overall depth of about 4 ft, and each fuel tank compartment 11 has a width of about 1.0 ft.
33. The fuel tank 10 of any one of embodiments 1 to 32, wherein each fuel tank compartment 11 has a fuel volume capacity of up to about 119 gallons of fuel (or any number of gallons from 1.0 gallon to about 119 gallons, in increments of 0.1 gallons, or any range therebetween, e.g., from about 100 gallons to about 118.5 gallons).
34. The fuel tank 10 of any one of embodiments 1 to 33, wherein walls 25 of said fuel tank 10 are formed from steel sheet/plate metal.
35. The fuel tank 10 of embodiment 34, wherein said steel sheet/plate metal has a sheet thickness of from about ¼ inch to about ¾ inch.
36. The fuel tank 10 of embodiment 34 or 35, wherein said steel sheet/plate metal has a sheet thickness of from about ¼ inch to about ⅜ inch.

Methods of Making Fuel Tanks

37. A method of making the fuel tank 10 of any one of embodiments 1 to 36, said method comprising: combining on or more sheets of material to form the fuel tank 10 (i.e., a sheet to form outer side surface 22*a*, a sheet to form inner side surface 25*a*, a sheet to form front surface 21*a*, a sheet to form rear surface 28*a*, a sheet to form upper surface 24*a*, and a sheet to form lower surface 23*a* of fuel tank compartments 11*a*).
38. The method of embodiment 37, wherein said combining step comprises: cutting one or more sheets of material to form individual wall portions of the fuel tank (i.e., a sheet to form outer side surface 22*a*, a sheet to form inner side surface 25*a*, a sheet to form front surface 21*a*, a sheet to form rear surface 28*a*, a sheet to form upper surface 24*a*, and a sheet to form lower surface 23*a* of fuel tank compartments 11*a*), and welding two or more individual wall portions to one another to form the fuel tank (i.e., welding the sheet forming outer side surface 22*a* to the sheet to forming front surface 21*a*, a sheet to form rear surface 28*a*, the sheet forming upper surface 24*a*, and the sheet forming lower surface 23*a* of fuel tank compartments 11*a*).
39. The method of embodiment 37 or 38, further comprising: attaching a fuel tank compartment outlet member 19 to each fuel tank compartment 11.
40. The method of any one of embodiments 37 to 39, further comprising: attaching one or more lifting members 13 to the fuel tank 10.

Methods of Using Fuel Tanks

41. A method of using the fuel tank 10 of any one of embodiments 1 to 36, said method comprising: loading the fuel tank 10 onto a bed of a vehicle (not shown).
42. A method of using the fuel tank 10 of any one of embodiments 1 to 36, said method comprising: unloading the fuel tank 10 off of a bed of a vehicle.
43. The method of embodiment 41 or 42, wherein the vehicle comprises a truck.
44. The method of any one of embodiments 41 to 43, further comprising: filling one or more of the fuel tank compartments 11 (i.e., with fuel).
45. A method of using the fuel tank 10 of any one of embodiments 1 to 44, said method comprising: pumping fuel from one or more of the fuel tank compartments 11.
46. A method of using the fuel tank 10 of any one of embodiments 1 to 36, said method comprising: filling one or more of the fuel tank compartments 11.

It should be understood that although the above-described fuel tanks and methods are described as "comprising" one or more components, features or steps, the above-described fuel tanks and methods may "comprise," "consists of," or "consist essentially of" any of the above-described components and/or features and/or steps of the fuel tanks and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a fuel tank and/or method that "comprises" a list of elements (e.g., components or features or steps) is not necessarily limited to only those elements (or components or features or steps), but may include other elements (or components or features or steps) not expressly listed or inherent to the fuel tank and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a fuel tank and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described fuel tanks and/or methods may comprise, consist essentially of, or consist of any of the herein-described components and features, as shown in the figures with or without any additional feature(s) not shown in the figures. In other words, in some embodiments, the fuel tank and/or method of the present invention may have any additional feature that is not specifically shown in the figures. In some embodiments, the fuel tanks and/or methods of the present invention do not have any additional features other than those (i.e., some or all) shown in the figures, and such additional features, not shown in the figures, are specifically excluded from the fuel tank and/or method.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Fuel tanks, similar to exemplary fuel tank 10 shown in FIGS. 1-8, were prepared using one or more cutting (e.g., blow torching) and/or welding steps. The fuel tank was prepared from steel metal sheets/plates having a sheet thickness of from ¼ inch. The resulting fuel tank had eight adjacent fuel tank compartments with an overall height of 4 feet (ft), an overall depth of 4 ft, and an overall width of 8 ft for the fuel tank. Each eight adjacent fuel tank compartment had a width of about 1.0 ft.

The brackets 18 and shelf 17 where the fuel pump 16 sits was made out of ½ inch metal plate. 2" diameter fuel tank compartment inlet members (i.e., couplers) 19 were connected to each fuel tank compartment inlet opening 14. 1" diameter fuel tank compartment outlet members (i.e., couplers) 12 were connected to each fuel tank compartment outlet opening 20.

Some completed fuel tanks were prepared with the following features: a 20 gallon per minute fill right pump mounted with a flex hose that will reach all compartments, a quick connect to make connection to a shut-off valve 26 from coupler at each fuel tank compartment 11; each fuel tank compartment 11 has a 90 degree 1" fitting (i.e., fuel tank compartment outlet member 12) coming out of the 1" coupler that is welded to each tank; a 1" valve connected to the 90 degree fitting that will be used to open or close fuel from each tank and it will also have a quick connect to connect to fuel hose; on the top of tank there is connected a 2"×6" coupler that will be screwed in 2" coupler that will allow fuel to be filled; and a 2" vented cap that will be screwed onto the 6" coupler.

From the above disclosure of the general principles of the present invention and the preceding detailed description, those skilled in this art will readily comprehend the various modifications, re-arrangements and substitutions to which the present invention is susceptible. Therefore, the scope of the invention should be limited only by the following claims and equivalents thereof. In addition, it is understood to be within the scope of the present invention that the disclosed and claimed fuel tanks and/or methods may be useful in other applications. Therefore, the scope of the invention may be broadened to include the use of the claimed and disclosed structures for such other applications.

What is claimed is:

1. A fuel tank comprising:

at least three adjacent fuel tank compartments integrally connected to one another, with each fuel tank compartment comprising:

a fuel tank compartment inlet opening along an upper surface of said fuel tank compartment, a fuel tank compartment outlet opening along and within a lower front side surface of said fuel tank compartment, and a fuel tank compartment outlet member extending outward from said fuel tank compartment outlet opening along said lower front side surface;

wherein all of said at least three adjacent fuel tank compartments share (i) a bottom wall of said fuel tank, (ii) a front wall of said fuel tank, (iii) a rear wall of said fuel tank, and (iv) a top wall of said fuel tank;

wherein two lifting members are positioned proximate each of opposite upper surface portions or opposite side surface portions of said fuel tank.

2. The fuel tank of claim 1, wherein said fuel tank compartment outlet member has a first end connectable to said fuel tank compartment outlet opening and a second end opposite said first end, said second end having a fuel tank compartment outlet member opening that is substantially parallel to said upper surface.

3. The fuel tank of claim 1, wherein said fuel tank compartment outlet member extends outward from said lower front side surface a distance $d_1$ with $d_1$ being less than about 6.0 inches, and along said lower front side surface a distance $d_2$ with $d_2$ being less than about 6.0 inches.

4. The fuel tank of claim 1, wherein said fuel tank compartment outlet member extends outward from said lower front side surface and comprises a 90° angle portion along said fuel tank compartment outlet member.

5. The fuel tank of claim 1, further comprising a single shared wall between any two adjacent fuel tank compartments.

6. The fuel tank of claim 5, wherein said fuel tank comprises n adjacent fuel tank compartments integrally connected to one another in a side-by-side configuration, and (n +1) total vertically-extending side walls within said fuel tank.

7. The fuel tank of claim 6, wherein n ranges from 3 to 8.

8. The fuel tank of claim 7, wherein n is 8.

9. The fuel tank of claim 1, further comprising a hose having a hose length that enables said hose to extend from (i) any fuel tank compartment outlet opening to (ii) a central location along an upper portion of said front surface proximate said upper surface.

10. The fuel tank of claim 1, further comprising a hose connector for each fuel tank compartment, wherein each hose connector is size so as to connect to (i) said fuel tank compartment outlet member, and (ii) a hose; and a shut-off valve for each fuel tank compartment, wherein each shut-off valve is size so as to connect to (i) said fuel tank compartment outlet opening or (ii) said fuel tank compartment outlet member so as to be positioned between said fuel tank compartment and said hose.

11. The fuel tank of claim 1, wherein each fuel tank compartment comprises a fuel tank compartment inlet member extending upward from said upper surface, and each fuel tank compartment inlet member is positioned within an outer periphery of said fuel tank.

12. The fuel tank of claim 1, wherein said fuel tank has an overall width of about 8 ft, an overall height of about 4 ft, and an overall depth of about 4 ft, and each fuel tank compartment has a width of about 1.0 ft.

13. The fuel tank of claim 1, wherein each fuel tank compartment independently has a fuel volume capacity of up to about 119 gallons of fuel.

14. The fuel tank of claim 1, wherein walls of said fuel tank are formed from steel sheet metal having a sheet thickness of from about ½inch to about ¾inch.

15. A fuel tank comprising:

from three to eight adjacent fuel tank compartments integrally connected to one another, with each fuel tank compartment comprising:

a fuel tank compartment inlet opening along an upper surface of said fuel tank compartment, a fuel tank compartment outlet opening along and within a lower front side surface of said fuel tank compartment, and a fuel tank compartment outlet member extending outward from said fuel tank compartment outlet opening along said lower front side surface;

wherein all of said three to eight adjacent fuel tank compartments share a bottom wall of said fuel tank, a front wall of said fuel tank, a rear wall of said fuel tank, and a top wall of said fuel tank;

wherein two lifting members are positioned proximate each of opposite upper surface portions or opposite side surface portions of said fuel tank.

16. The fuel tank of claim 15, wherein each fuel tank compartment independently has a fuel volume capacity of about 119 gallons of fuel.

17. A fuel tank comprising:

eight adjacent side-by-side fuel tank compartments integrally connected to one another, with each fuel tank compartment comprising:

a fuel tank compartment inlet opening along an upper surface of said fuel tank compartment, a fuel tank compartment outlet opening along and within a lower front side surface of said fuel tank compartment, and a fuel tank compartment outlet member extending outward from said fuel tank compartment outlet opening along said lower front side surface;

two lifting members positioned proximate each of opposite upper surface portions or opposite side surface portions of said fuel tank, wherein each of said eight adjacent side-by-side fuel tank compartments share (i) a bottom wall of said fuel tank, (ii) a front wall of said fuel tank, (iii) a rear wall of said fuel tank, and (iv) a top wall of said fuel tank, and each fuel tank compartment independently has a fuel volume capacity of up to about 119 gallons of fuel.

* * * * *